US007926802B2

(12) United States Patent
Shimokawa

(10) Patent No.: US 7,926,802 B2
(45) Date of Patent: Apr. 19, 2011

(54) FEED APPARATUS FOR PRINTING PRESS

(75) Inventor: Hiromichi Shimokawa, Ibaraki (JP)

(73) Assignee: Komori Corporation, Tokyo (JP)

( * ) Notice: Subject to any disclaimer, the term of this patent is extended or adjusted under 35 U.S.C. 154(b) by 166 days.

(21) Appl. No.: 12/221,531

(22) Filed: Aug. 4, 2008

(65) Prior Publication Data

US 2009/0039589 A1 Feb. 12, 2009

(30) Foreign Application Priority Data

Aug. 9, 2007 (JP) ..... 2007-207645

(51) Int. Cl.
*B65H 3/40* (2006.01)

(52) U.S. Cl. ..... 271/93; 271/103

(58) Field of Classification Search ..... 271/14, 271/93, 103

See application file for complete search history.

(56) References Cited

U.S. PATENT DOCUMENTS 1,442,718 A * 1/1923 Free ..... 271/91
2,247,473 A * 7/1941 Binder ..... 271/103
3,071,371 A * 1/1963 Wickland ..... 271/92
3,931,964 A * 1/1976 Schwebel ..... 271/93
3,937,457 A * 2/1976 Schwebel ..... 271/92
4,327,906 A * 5/1982 Frohlich et al. ..... 271/103
4,438,916 A * 3/1984 Kawaguchi ..... 271/93
4,458,891 A * 7/1984 Kawaguchi ..... 271/93
4,759,537 A * 7/1988 Illig et al. ..... 271/11
4,869,489 A * 9/1989 Wirz et al. ..... 271/90
4,940,221 A * 7/1990 Wirz et al. ..... 271/107
5,064,184 A * 11/1991 Liepert ..... 271/14
5,074,538 A * 12/1991 Naumann ..... 271/11
5,332,206 A * 7/1994 Hirose et al. ..... 271/90
5,447,300 A * 9/1995 Junger ..... 271/11
7,014,185 B2 * 3/2006 Ostreicher et al. ..... 271/90
2002/0173048 A1 * 11/2002 Nakazawa et al. ..... 436/180

FOREIGN PATENT DOCUMENTS

JP 03-024511 U 5/1991

* cited by examiner

*Primary Examiner* — Stefanos Karmis
*Assistant Examiner* — Howard Sanders
(74) *Attorney, Agent, or Firm* — Blakely, Sokoloff, Taylor & Zafman LLP

(57) ABSTRACT

A feed apparatus for a printing press includes a first sucker device and a second sucker device. The first sucker device includes a guide nozzle, a sucker which is supported by said guide nozzle to be vertically movable and includes a chuck hole at a bottom for chucking the sheet, and a spring which biases said sucker toward a distal end of said guide nozzle. The guide nozzle includes a first air passage for drawing the sheet and a second air passage for drawing said sucker. The sucker includes a closing portion which closes said second air passage when said sucker is located at an upper limit against a biasing force of said spring.

9 Claims, 6 Drawing Sheets

FEED APPARATUS FOR PRINTING PRESS

BACKGROUND OF THE INVENTION

The present invention relates to a feed apparatus for a printing press, which chucks sheets stacked on a pile board one by one from the uppermost one and feeds the chucked sheet.

As shown in Japanese Utility Model Laid-Open No. 3-24511, a conventional feed apparatus for a printing press comprises the first sucker member which chucks sheets which are supported to be vertically movable and stacked on a pile board one by one from the uppermost one, and the second sucker member which chucks the sheet transferred from the first sucker member and conveys it. Of the two sucker members, the first sucker member comprises a cylindrical guide nozzle, a sucker fitted on the outer surface of the guide nozzle to be vertically movable and having a chuck hole in its lower end face, and a sucker spring which is elastically mounted between the sucker and guide nozzle and biases the sucker downward with respect to the guide nozzle.

In this arrangement, when the first sucker member that has moved downward is moved close to the sheet and air in the guide nozzle is drawn, the sheet is chucked by the chuck hole of the sucker. When the sheet closes the chuck hole, the interior of the sucker is set in a negative pressure state, and the sucker moves upward against the spring force of the sucker spring. Subsequently, when the sheet is chucked by the second sucker member, it is transferred to the second sucker member. After that, air drawing into the guide nozzle is stopped, and the second sucker member conveys the sheet.

In the conventional feed apparatus for the printing press, when the second sucker member chucks the sheet and conveys it, drawing air supply to the guide nozzle of the first sucker member is stopped. Thus, the spring force of the sucker spring moves the sucker downward. At this time point, since the second sucker member has not completely conveyed the sheet yet, the sheet is present below the sucker of the first sucker member. Therefore, the sucker of the first sucker member that moves downward may come into contact with the sheet. This may scratch the sheet, or separate the chucked sheet from the second sucker member.

When the sucker of the first sucker member pushes the sheet downward, the sheet may interfere with blowing air discharged from a leveling foot. In this case, air discharged from the leveling foot is not supplied to the portion between the first and second sheets, and the sheets cannot be reliably fed one by one.

SUMMARY OF THE INVENTION

It is an object of the present invention to provide a feed apparatus for a printing press, which can reliably feed sheets one by one without scratching them.

In order to achieve the above object, according to the present invention, there is provided a feed apparatus for a printing press, comprising a first sucker device which chucks sheets, which are stacked and supported to be vertically movable, one by one from the uppermost one, and a second sucker device which chucks the sheet transferred from the first sucker device and conveys the sheet, the first sucker device comprising a guide nozzle, a sucker which is supported by the guide nozzle to be vertically movable and includes a chuck hole at a bottom for chucking the sheet, and a spring which biases the sucker toward a distal end of the guide nozzle, the guide nozzle comprising a first air passage for drawing the sheet and a second air passage for drawing the sucker, and the sucker comprising a closing portion which closes the second air passage when the sucker is located at an upper limit against a biasing force of the spring.

DESCRIPTION OF THE PREFERRED EMBODIMENTS

Figure 1:
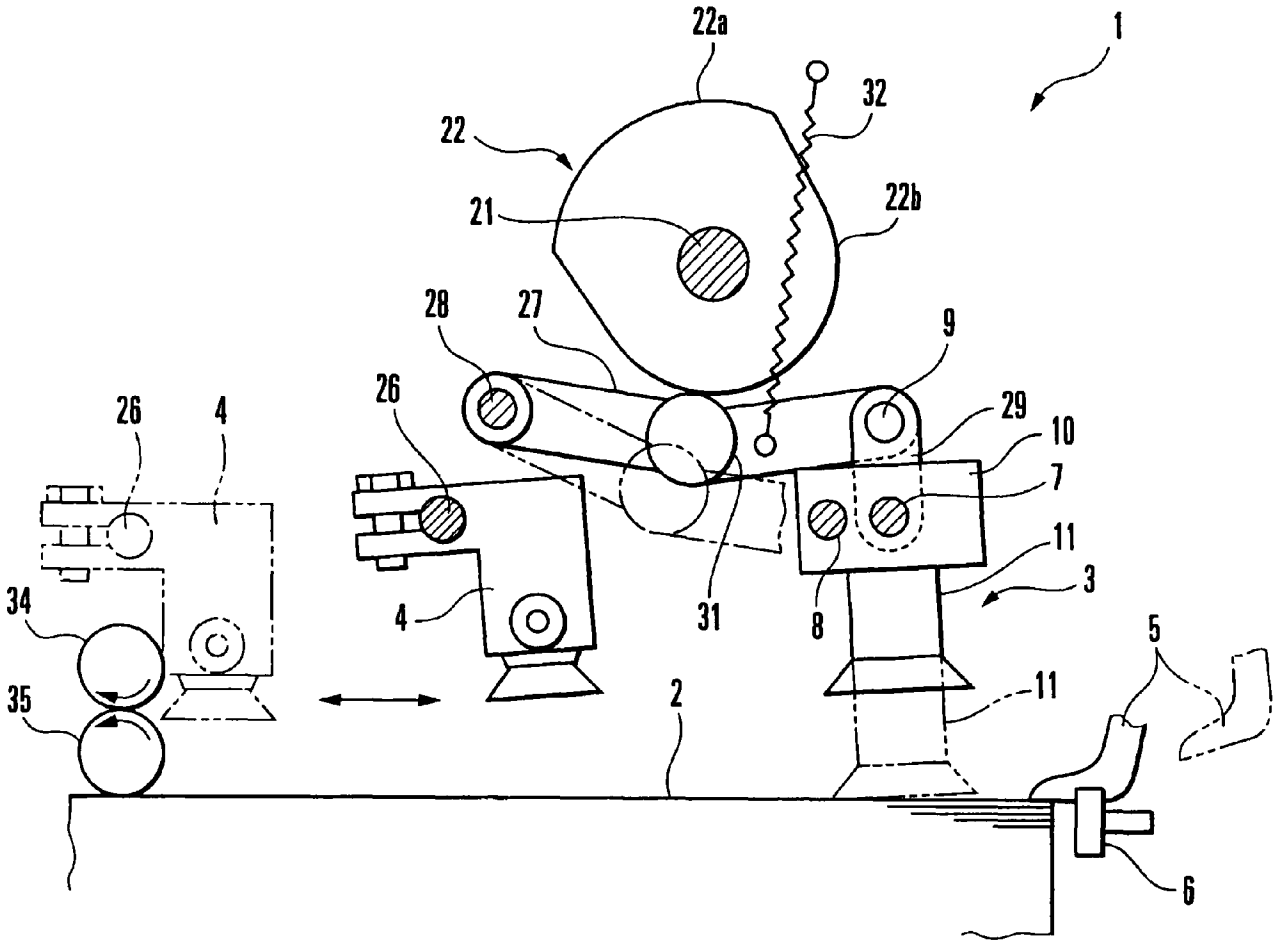
FIG. 1 is a side view of a feed apparatus for a printing press according to the first embodiment of the present invention.

The first embodiment of the present invention will be described in detail with reference to FIGS. 1 to 5C. As shown in FIG. 1, a feed apparatus 1 for a printing press comprises first sucker devices 3 each of which chucks sheets 2 stacked on a pile board one by one from the uppermost one, second sucker devices 4 each of which chucks the sheet 2 transferred from the corresponding sucker device 3 and conveys it, a leveling foot 5 which enters between the first sheet chucked by the sucker device 3 and a sheet (second sheet) under the first sheet, holds the second sheet, and supplies air to separate the first sheet from the second sheet, and an air blower 6 which supplies air to the side surfaces of the sheets 2 so that the sheets 2 stacked on the pile board can be separated well.

Figure 3B:
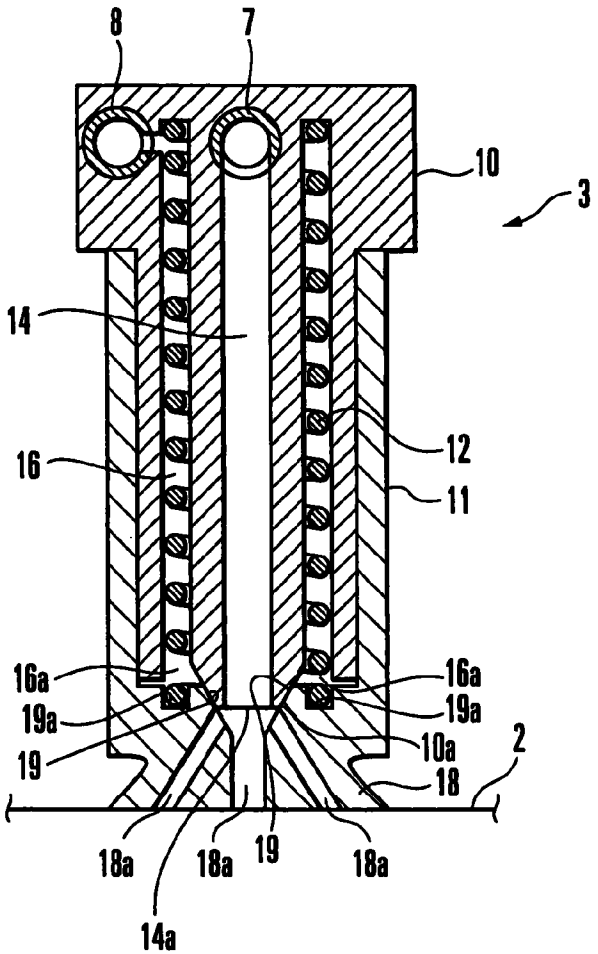
FIGS. 3A and 3B are sectional views showing the first sucker device shown in FIG. 1 in the sheet non-chucking state and sheet chucking state, respectively.
Figure 3A:
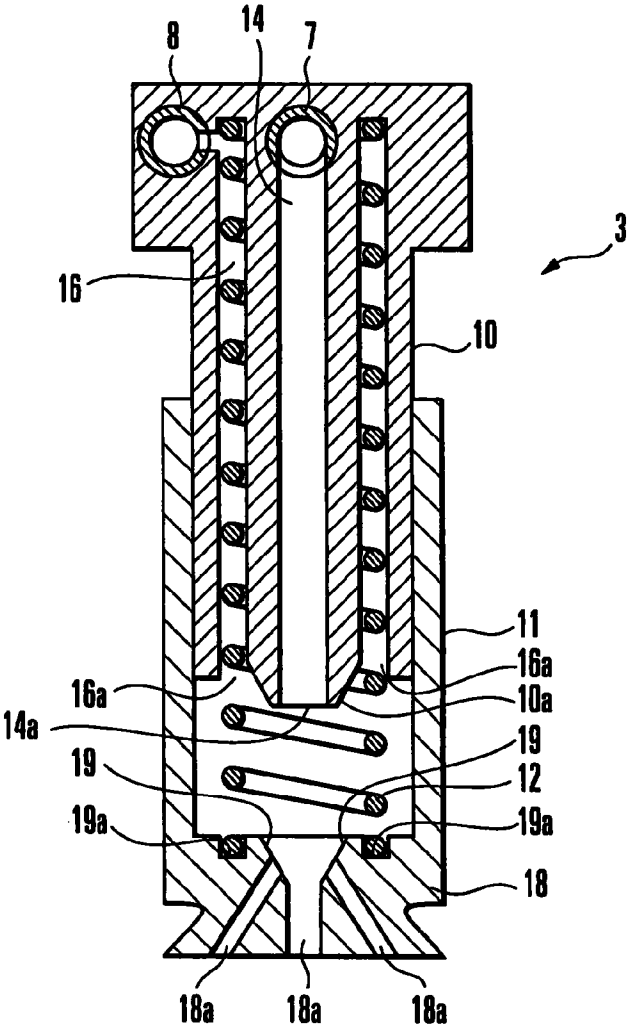
Figure 4:
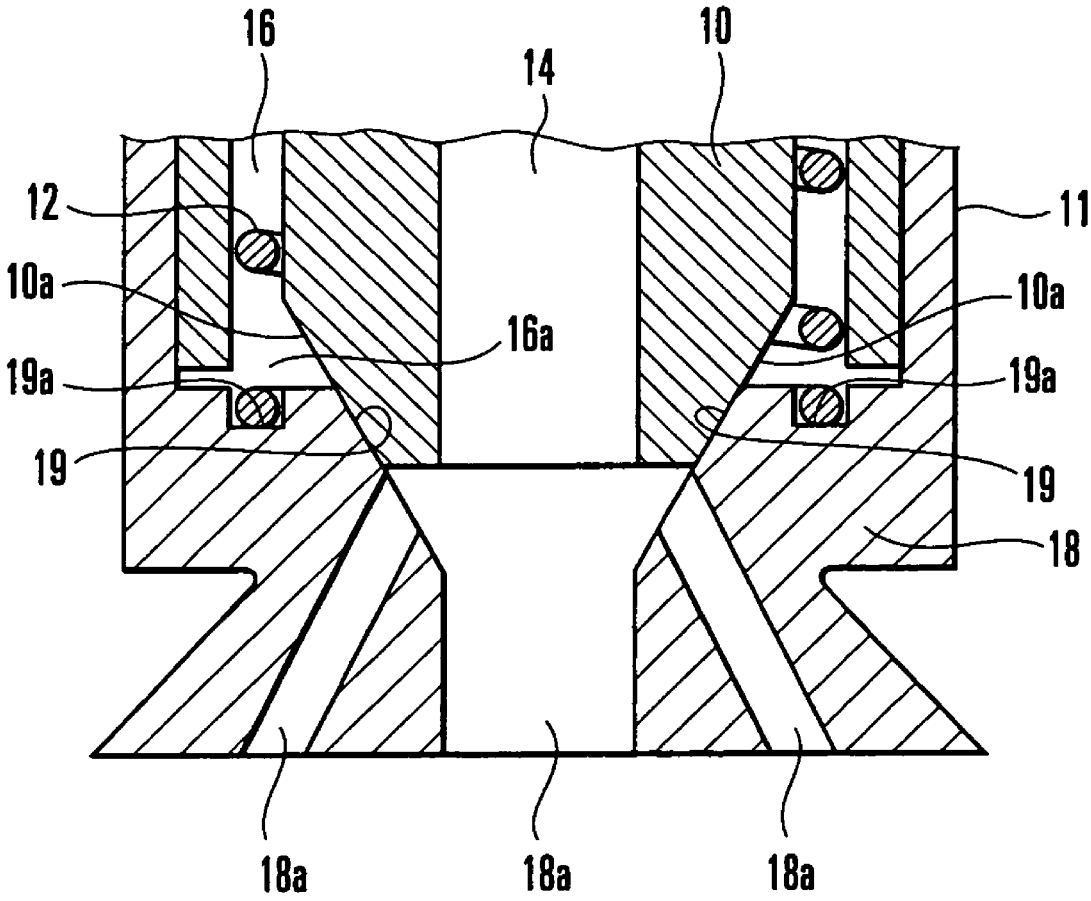
FIG. 4 is an enlarged sectional view of the main part of the first sucker device shown in FIG. 3B.

As shown in FIG. 3A, each sucker device 3 comprises an almost cylindrical guide nozzle 10, a blind cylindrical sucker 11 which fits on the outer surface of the guide nozzle 10 and is supported slidably and vertically movable, and a compression coil spring 12 which biases the sucker 11 downward with respect to the guide nozzle 10. A lower end 10*a* of the guide nozzle 10 forms a circular truncated cone with a tapered distal end, as shown in FIG. 4.

Figure 2:
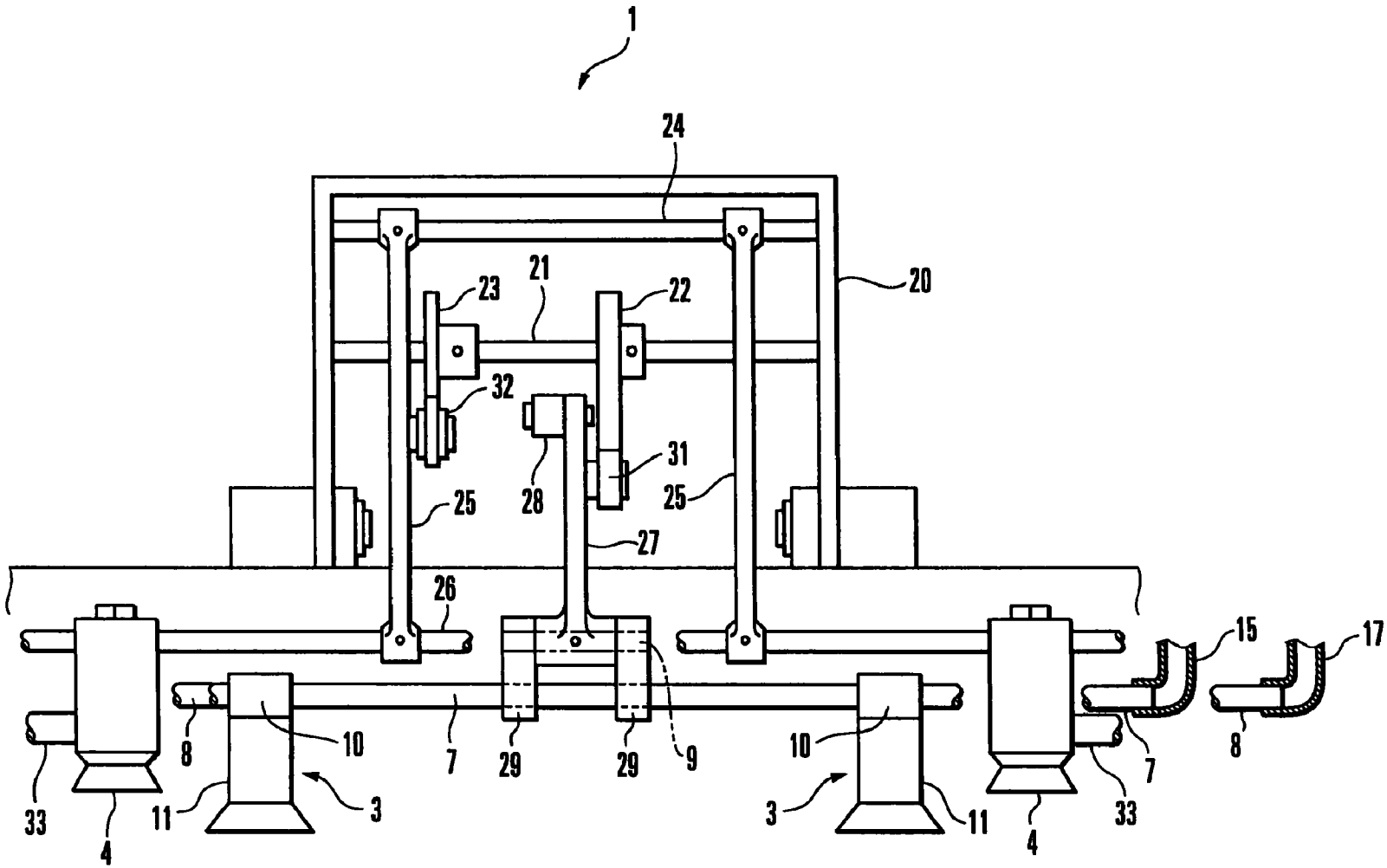
FIG. 2 is a front view of the feed apparatus shown in FIG. 1.

The guide nozzle 10 has, at its central portion, a sheet drawing air passage 14 extending in the vertical direction and having an opening 14*a* at its lower end. When the guide nozzle 10 moves downward, the air passage 14 communicates with chuck holes 18*a* of the sucker 11 through the opening 14*a*, as shown in FIG. 3B. As shown in FIG. 2, an air pipe 7 extends through the upper portion of the pair of guide nozzle 10, and the air pipe 7 is axially mounted on the guide nozzle 10. The upper end of the air passage 14 communicates with the air pipe 7. The air pipe 7 is connected to a hose 15 which is connected to an intake pump and exhaust pump (neither is shown) through rotary valves.

As shown in FIG. 3A, the guide nozzle 10 has a cylindrical space around the air passage 14. The cylindrical space constitutes a sucker drawing air passage 16 in which the compression coil spring 12 is loaded. The air passage 16 has an exhaust port 16*a* having an opening at its lower end and exposed to the internal space of the sucker 11. When the sucker 11 has moved downward, the air passage 16 communicates with the chuck holes 18*a* through the exhaust port 16*a*. The upper end of the air passage 16 communicates with an air pipe 8 extending through the guide nozzle 10. As shown in FIG. 2, the air pipe 8 is connected to a hose 17 connected to an intake pump (not shown) through a rotary valve (not shown).

As shown in FIG. 3A, the sucker 11 has a plurality of chuck holes 18*a* in a bottom 18. As shown in FIG. 4, the inner circumferential edge of the upper end of each chuck hole 18*a* forms an inverted cone. The chuck holes 18*a* constitute a valve seat 19 serving as a closing portion. Namely, when the valve seat 19 comes into contact with the lower end 10*a* of the guide nozzle 10, it closes the exhaust port 16*a* of the air passage 16; when it separates from the lower end 10*a* of the guide nozzle 10, it opens the exhaust port 16*a* of the air passage 16. The lower end 10*a* of the guide nozzle 10 constitutes a valve body with respect to the valve seat 19.

When air is drawn into the air passages 14 and 16 of the guide nozzle 10 and the sucker 11 moves upward and reaches the upper limit, the valve seat 19 closes the exhaust port 16*a* of the air passage 16. A ring-shaped spring bearing 19*a* forms a recess at the upper edge of the valve seat 19 to surround the valve seat 19. The compression coil spring 12 loaded in the air passage 16 of the guide nozzle 10 is elastically mounted between the spring bearing 19*a* and the upper end of the air passage 16. A gap that does not interfere with the flow of air drawn from the air pipe 8 is reserved between the air passage 16 loaded with the compression coil spring 12 and the compression coil spring 12.

In this embodiment, the air passage 14 is formed at the central portion of the guide nozzle 10, and the air passage 16 loaded with the compression coil spring 12 is formed to surround the air passage 14. According to this embodiment, the structure of the guide nozzle 10 can be simplified and down-sized.

A sucker frame 20 provided above the sheets 2 stacked on the pile board projects backward from the upper end of a sheet feed frame. As shown in FIG. 2, a cam 22 for the pair of sucker device 3 and a cam 23 for the sucker devices 4 are axially mounted on a cam shaft 21 which is axially supported by the sucker frame 20. The guide nozzles 10 of the pair of sucker devices 3 are pivotally mounted on the lower end of the sucker frame 20 through adjusting devices (not shown) such that the angles of inclination of the guide nozzles 10 are adjustable.

A pair of arms 25 vertically hang downward from an arm shaft 24 axially supported by the sucker frame 20. The arms 25 support a support shaft 26 horizontally, and the pair of sucker devices 4 are fixed at the two ends of the support shaft 26. A cam lever 27 is pivotally mounted on a bracket 28 fixed to the sheet feed frame, and a pair of levers 29 which support the air pipe 7 are pivotally attached to a pin 9 formed at the free end of the cam lever 27. The air pipe 7, together with the air pipe 8, supports the guide nozzles 10. A cam follower 31 is pivotally mounted at the center of the cam lever 27. As shown in FIG. 1, the tensile force of a tension coil spring 32 brings the cam follower 31 into tight contact with the cam surface of the cam 22.

In this arrangement, when the cam 22 rotates, the cam surface of the cam 22 cooperates with the tensile force of the tension coil spring 32 to swing the cam lever 27. This pushes the sucker 11 of the sucker device 3 upward. The spring force of the compression coil spring 12 pushes the sucker 11 of the sucker device 3 downward.

A cam follower 32 is pivotally mounted on one of the pair of arms 25. A spring member (not shown) brings the cam follower 32 into tight contact with the cam surface of the cam 23. When the cam 23 rotates, the arms 25 swing, and the sucker devices 4 reciprocate once per turn of the cam 23 between the position indicated by a solid line and the position indicated by an alternate long and two dashed line in FIG. 1. As shown in FIG. 2, the sucker devices 4 are connected to a hose 33 connected to an intake pump through a rotary valve (neither is shown).

As shown in FIG. 1, a pair of upper and lower feed rollers 34 and 35 are arranged at the front end of the feed apparatus. The rollers 34 and 35 capture the sheet 2 released from the sucker devices 4 and feed it onto a feeder board (not shown).

Figures 5A, 5B, 5C:
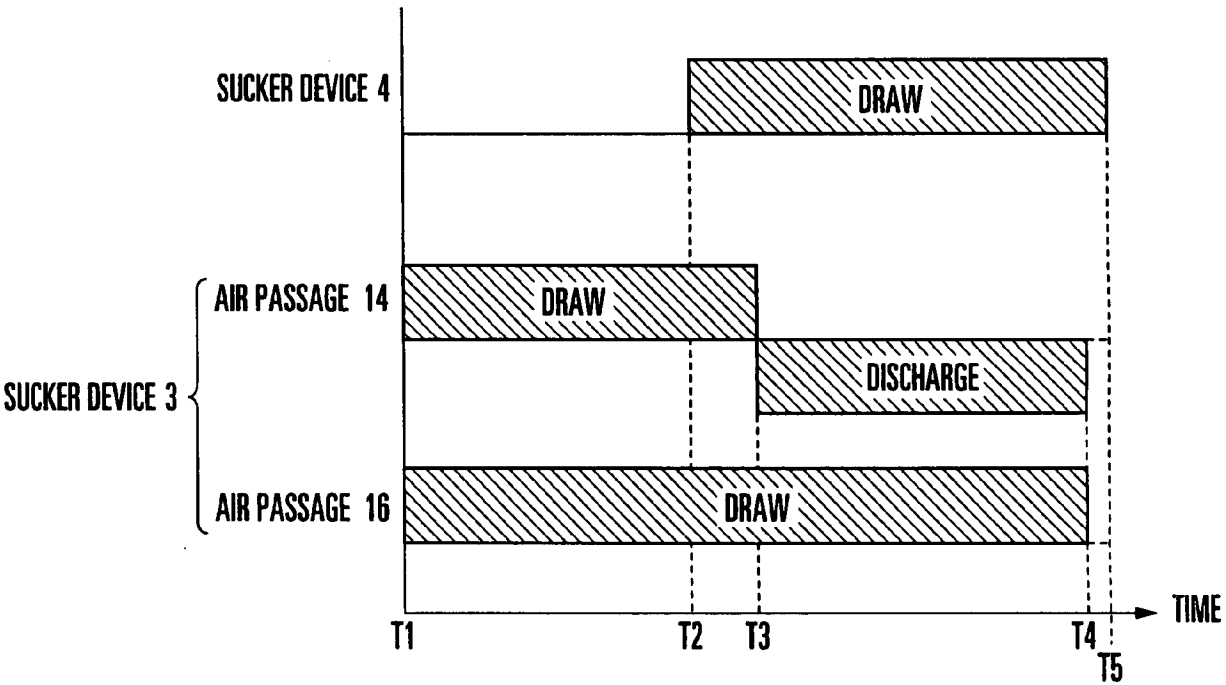
FIGS. 5A to 5C are timing charts showing timings at which the first sucker device and second sucker device draw/discharge air.

The feed operation of the feed apparatus for the printing press having the above arrangement will be described with reference to FIGS. 5A to 5C. First, the sucker devices 3 move downward, and the suckers 11 stop at a position (indicated by an alternate long and two short dashed line in FIG. 1) close to the sheet 2 on the pile board. Subsequently, as shown in FIGS. 5B and 5C, at time T1, air drawing is started into the air passages 14 and 16 (FIG. 3) of the sucker devices 3 through the hoses 15 and 17 (FIG. 2). When air is drawn into the air passages 14 and 16, the uppermost one of the sheets 2 is chucked by the chuck holes 18*a* of the suckers 11. Thus, the sheet 2 closes the chuck holes 18*a*.

As air is continuously drawn into the air passages 14 and 16, the interiors of the sucker devices 3 are set in the negative pressure state. Thus, the external atmospheric pressure compresses the compression coil springs 12 in the guide nozzles 10, and the suckers 11 move upward, while chucking the sheet 2, due to the tensile operation of the compression coil springs 12. When the suckers 11 reach the upper limit as shown in FIG. 3B, the valve seats 19 of the suckers 11 close the exhaust ports 16*a* of the air passages 16.

As air is continuously drawn into the air passages 16, the interiors of the air passages 16 are set in the negative pressure state. Thus, the suckers 11 are maintained at the upper limit. At this time, a small-diameter portion 22*b* of the cam 22 (FIG. 2) comes into contact with the cam follower 31 to move the cam lever 27 upward, as shown in FIG. 1, so that the sucker devices 3 move upward together with the suckers 11, to return to the position indicated by a solid line. When the suckers 11 move upward, the leveling foot 5 enters and reliably presses the sheets so that air discharged from the leveling foot 5 does not cause the sheets from the second sheet to move upward to follow the first sheet.

As the sucker devices 3 move upward, the sheet 2 chucked by the suckers 11 also moves upward to come close to the sucker devices 4. As shown in FIG. 5A, at time T2, air is drawn into the sucker devices 4 through the hose 33, and the sheet 2 chucked by the sucker devices 3 is chucked by the sucker devices 4 as well. At this time, air is continuously drawn into the air passages 14 and 16.

At time T3 which is slightly after the time T2, as shown in FIG. 5B, air drawn into the air passages 14 is stopped, and air is discharged from the air passages 14 in turn. Thus, the sheet 2 chucked by the sucker devices 3 is released and transferred from the sucker devices 3 to the sucker devices 4. At this time, as shown in FIG. 5C, air is continuously drawn into the air passages 16 of the sucker devices 3. Thus, the valve seats 19 of the suckers 11 close the exhaust ports 16*a* at the lower ends of the air passages 16, and the suckers 11 are maintained at the upper limit.

As described above, immediately after the sheet 2 is transferred from the sucker devices 3 to the sucker devices 4, the suckers 11 of the sucker devices 3 are maintained at the upper limit and do not move downward, and accordingly will not come into contact with the sheet 2 chucked by the sucker devices 4. Thus, the sheet 2 will not be scratched, or will be separated from the sucker devices 4. Since the sheet 2 released from the suckers 11 is not pushed down by the suckers 11, the sheet 2 does not interfere with air blowing from the leveling foot 5. Therefore, the leveling foot 5 reliably holds the second and subsequent sheets, and air is reliably discharged to the gap between the first and second sheets. Thus, the sheets 2 can be reliably supplied one by one.

When the sheet 2 is transferred from the sucker devices 3 to the sucker devices 4, the cam 23 and cam follower 32 swing the arms 25. Thus, the sucker devices 4 that chuck the sheet 2 move forward from the position indicated by the solid line to the position indicated by the alternate long and two short dashed line in FIG. 1, and the feed rollers 34 and 35 capture the leading edge of the sheet 2.

At time T4, as shown in FIGS. 5B and 5C, air discharge to the air passages 14 and air drawing into the air passages 16 are stopped. When air drawing into the air passages 16 is stopped, the negative pressure state in the air passages 16 is canceled, and the spring forces of the compression coil springs 12 move the suckers 11 downward. At this time, the cam 22 rotates so that a large-diameter portion 22*a* comes into contact with the cam follower 31, and the cam lever 27 swings to the position indicated by an alternate long and two short dashed line in FIG. 1. Thus, the suckers 11 stop at an upper position where they are close to the sheet 2.

At time T5, as shown in FIG. 5A, air drawing into the sucker devices 4 is stopped. Thus, the sheet 2 chucked by the sucker devices 4 is released. The sheet 2 captured by the feed rollers 34 and 35 is fed onto the feeder board and supplied to the printing unit. After that, the cam 23 and cam follower 32 swing the arms 25, so that the sucker devices 4 that have released the sheet 2 move backward to the position indicated by the solid line in FIG. 1.

Figure 6B:
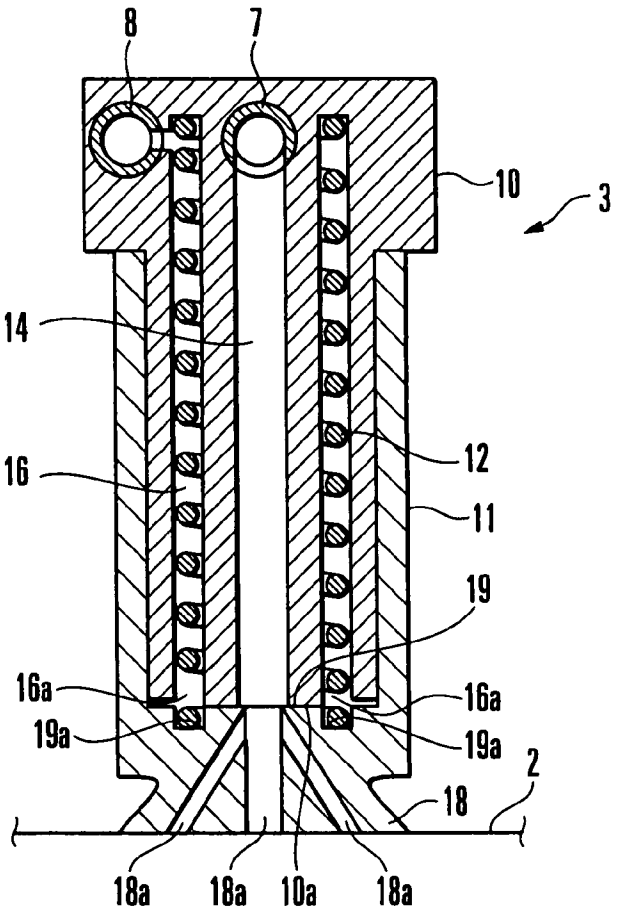
FIGS. 6A and 6B are sectional views showing the first sucker device according to the second embodiment of the present invention in a sheet non-chucking state and sheet chucking state, respectively.
Figure 6A:
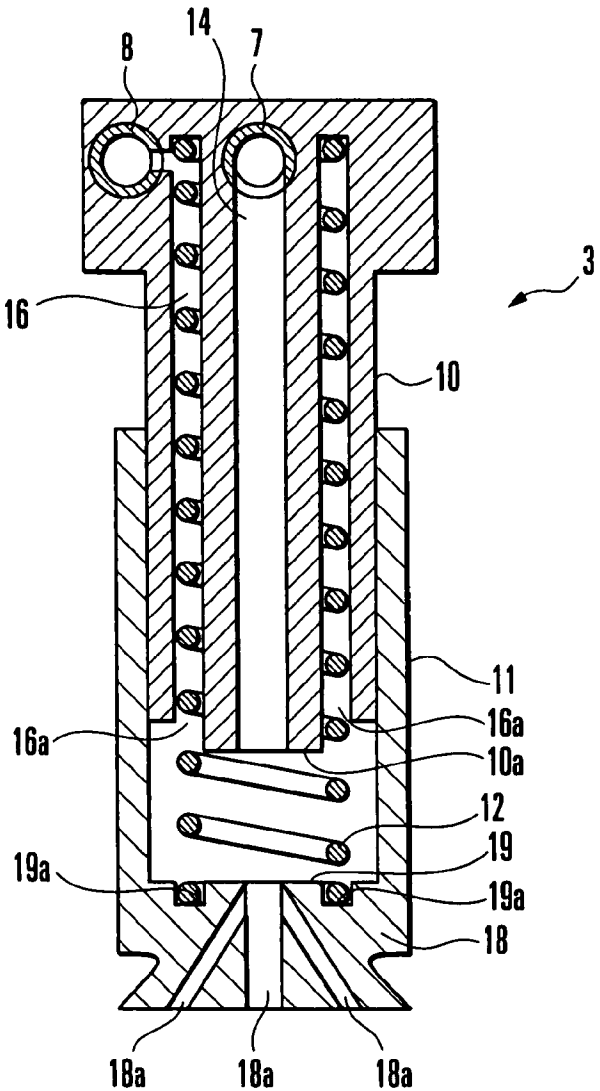

FIGS. 6A and 6B show the second embodiment of the present invention. In the second embodiment, a lower end 10*a* of each guide nozzle 10 is formed flat, and a valve seat 19 of a bottom 18 of a sucker 11 which is in contact with the lower end 10*a* is also formed flat. The lower end 10*a* of the guide nozzle 10 and the valve seat 19 are formed of horizontal planes parallel to each other.

Although the timing to start air drawing into the air passages 16 is set at the time T1 in the above embodiment, it may be at any time between the time 1 when air drawing into the air passages 14 is started and the time T3 when air drawing is stopped. Although the timing to end air drawing into the air passages 16 is set at the time T4, it may be before the time T4 as far as it is a timing at which the sheet 2 conveyed by the sucker devices 4 is not located below the sucker devices 3.

As has been described above, according to the present invention, when transferring the sheet from the first sucker devices to the second sucker devices, although air drawing for the sheet is stopped, air drawing into the air passages is continued. Therefore, before the suckers of the first sucker devices move downward, the second sucker devices can convey the sheet. According to the present invention, the sheet can be prevented from being scratched by the suckers of the first sucker devices or from separated from the second sucker devices.

What is claimed is:

1. A feed apparatus for a printing press, comprising:

a first sucker device which chucks sheets, which are stacked and supported to be vertically movable, one by one from an uppermost one; and a second sucker device which chucks the sheet transferred from said first sucker device and conveys the sheet, said first sucker device comprising a guide nozzle, a sucker which is supported by said guide nozzle to be vertically movable and includes a chuck hole at a bottom for chucking the sheet, and a spring which biases said sucker toward a distal end of said guide nozzle, said guide nozzle comprising a first air passage for drawing the sheet and a second air passage for drawing said sucker, and said sucker comprising a closing portion which closes said second air passage when said sucker is located at an upper limit against a biasing force of said spring, wherein said first air passage is formed at a central portion of said guide nozzle, said second air passage comprising a cylindrical space formed so as to surround the first air passage.

2. A feed apparatus according to claim 1 wherein air continues to be drawn into said first and second air passages to thereby cause said sucker to chuck the sheet until said sucker reaches an upper limit of an upward movement thereof.

3. A feed apparatus for a printing press, comprising:

a first sucker device which chucks sheets, which are stacked and supported to be vertically movable, one by one from an uppermost one; and a second sucker device which chucks the sheet transferred from said first sucker device and conveys the sheet, said first sucker device comprising a guide nozzle, a sucker which is supported by said guide nozzle to be vertically movable and includes a chuck hole at a bottom for chucking the sheet, and a spring which biases said sucker toward a distal end of said guide nozzle, said guide nozzle comprising a first air passage for drawing the sheet and a second air passage for drawing said sucker, and said sucker comprising a closing portion which closes said second air passage when said sucker is located at an upper limit against a biasing force of said spring, wherein said first air passage is formed at a central portion of said guide nozzle, said second air passage is formed to surround said first air passage, and wherein said spring is loaded in said second air passage.

4. A feed apparatus according to claim 3 wherein, while said second sucker device holds the sheet by drawing, air drawing into said first air passage is stopped, and air drawing into said second air passage is continued.

5. A feed apparatus according to claim 3 wherein, while said second sucker device holds the sheet by drawing, air is discharged from said first air passage.

6. A feed apparatus according to claim 3 wherein, while said second sucker device conveys the sheet from below said first sucker device and no sheet is present under said first sucker device, air drawing into said second air passage is stopped.

7. A feed apparatus for a printing press, comprising:

a first sucker device which chucks sheets, which are stacked and supported to be vertically movable, one by one from an uppermost one; and a second sucker device which chucks the sheet transferred from said first sucker device and conveys the sheet, said first sucker device comprising a guide nozzle, a sucker which is supported by said guide nozzle to be vertically movable and includes a chuck hole at a bottom for chucking the sheet, and a spring which biases said sucker toward a distal end of said guide nozzle, said guide nozzle comprising a first air passage for drawing the sheet and a second air passage for drawing said sucker, and said sucker comprising a closing portion which closes said second air passage when said sucker is located at an upper limit against a biasing force of said spring, wherein a distal end of said guide nozzle including an opening of said first air passage forms a tapered circular truncated cone to constitute a valve body, and said closing portion comprises an inverted conical valve sheet which is formed at an inner circumferential edge of an upper end of said chuck hole of said sucker and engages with said valve body.

8. A feed apparatus according to claim 7 wherein, when said sucker is located at the upper limit and said closing portion closes said second air passage, air drawing into said second air passage holds said sucker.

9. A feed apparatus according to claim 1, wherein, after said sucker biased toward the distal end of said guide nozzle has chucked the sheet by the action of air drawn into said first and second air passages, said sucker moves upward against the biasing force of said spring by the action of a negative pressure created in said first and second air passages.

* * * * *